United States Patent [19]

Akatsuka

[11] Patent Number: 4,914,912

[45] Date of Patent: Apr. 10, 1990

[54] EXHAUST-MANIFOLD HEAT INSULATING BOARD

[75] Inventor: Nobuyuki Akatsuka, Shizuoka, Japan

[73] Assignee: Suzuki Jidosha Kogyo Kabushiki Kaisha, Shizuoka, Japan

[21] Appl. No.: 345,466

[22] Filed: Apr. 28, 1989

[30] Foreign Application Priority Data

May 19, 1988 [JP] Japan ..... 63-66138[U]

[51] Int. Cl.[4] ..... F01N 7/10

[52] U.S. Cl. ..... 60/323

[58] Field of Search ..... 60/323, 322, 299

[56] References Cited

U.S. PATENT DOCUMENTS

| | | | |
|---|---|---|---|
| 4,612,767 | 9/1986 | Engquist | 60/323 |
| 4,836,160 | 6/1989 | Valev | 60/323 |

FOREIGN PATENT DOCUMENTS

| | | | |
|---|---|---|---|
| 2037135 | 9/1971 | Fed. Rep. of Germany | 60/323 |
| 24356 | 2/1979 | Japan | 60/323 |
| 60-122524 | 8/1985 | Japan . | |
| 61-65231 | 5/1986 | Japan . | |
| 244806 | 10/1969 | U.S.S.R. | 60/323 |

*Primary Examiner*—Douglas Hart

*Attorney, Agent, or Firm*—Flynn, Thiel, Boutell & Tanis

[57] ABSTRACT

An exhaust-manifold heat insulating board is provided which has an insulating layer sandwiched between an inner layer and an outer layer. The inner and outer layers are laminated together and have an inner area and a peripheral area. The inner area has a depression with end portions formed therein and the peripheral area is formed into connecting tab portions which are positioned adjacent the end portions. Each of the connecting tab portions has a length greater than the width of the adjacent end portion of the depression.

3 Claims, 2 Drawing Sheets

EXHAUST-MANIFOLD HEAT INSULATING BOARD

FIELD OF THE INVENTION

This invention is directed to an exhaust-manifold heat insulting board for an internal combustion engine, and especially to an exhaust-manifold heat insulating board capable of preventing cracks caused by thermal stresses, without the use of reinforcing materials.

BACKGROUND OF THE INVENTION

FIG. 8 shows a heat insulating board 4 for an exhaust manifold 2 which is used to cut off the heat exhausted from an internal combustion engine. The damaging influence of heat on accessories of the internal combustion engine is decreased by cutting off or reducing the heat emitted from the exhaust manifold 2 by partially enclosing the manifold with the heat insulating board 4.

The above heat insulating board 4 for the exhaust manifold 2 is disclosed in Japanese Publication Nos. 60-122524 and 61-65231.

The heat insulating board disclosed in the earlier publication is utilized by using bolts to secure the heat insulating board to the exhaust manifold and press-fitting the exhaust manifold to the heat insulating board when fastening the bolts.

The heat insulating board disclosed in the latter publication is made by providing a space between the inside and outside materials of the heat insulating board and installing many heat-releasing projections on the outside material.

The known heat insulating board 4 for the exhaust manifold 2 as shown in FIG. 8 includes, for example, the type shown in FIGS. 5 through 7.

The heat insulating board 4 consists of an inside material layer 8 and outside material layer 10 which are laminated with a heat insulating material layer 6 as shown in FIG. 6. The board 4 is, as shown in FIG. 5, made by fixing together the peripheral area 12 of the inside material layer 8 and the outside material layer 10 by using the caulked connecting tab portions 14. That is, the tabs 14 on the inside layer 8 project over the edge portion of the outside layer 10 and are fixed thereto, as by being caulked thereto. The board 4 is also provided with a depression 18 at the internal area 16, excluding the peripheral area 12, of the inside material 8 and the outside material 10.

However, in this conventional heat insulating board 4, connecting tab portions 14 are not located directly adjacent or aligned with the adjacent end wall **18*e* of the depression 18, but rather are disposed outwardly along the periphery 12 on opposite sides of this end wall 18*e*. The portion 20 directly adjacent the end wall 18*e* is not fixedly coupled to the other layer. Therefore, thermal stresses, due to thermal deformation of the above depression 18, are concentrated on the peripheral area 12 facing or adjacent the end 18e, and cause cracks in the interface 22 between the connecting portion 14 and the non-connecting portion 20, thereby shortening the life of the heat insulating board 4**.

Although reinforcement can be used to prevent the above-described cracks, the cost of manufacturing the board 4 will increase.

SUMMARY OF THE INVENTION

The purpose of the present invention is to provide an exhaust-manifold heat insulating board capable of preventing cracks due to thermal stresses without the use of any reinforcements.

To accomplish the above purpose, the present invention features an exhaust manifold-heat insulating board made by integrating the peripheral area of the inside and outside materials of the board and by forming a depression in the internal area, excluding the above peripheral area, of the inside and outside materials. The board is equipped with a connecting tab portion, having a length longer than the width of the adjacent end of the depression, in the peripheral area directly facing the end of the depression, which tab caulks the layers of inside and outside materials together.

BRIEF DESCRIPTION OF THE DRAWINGS

FIGS. 1 through 4 show an exemplified embodiment of the present invention wherein:

FIG. 1 is a perspective view of the heat insulating board,

FIG. 2 is an enlarged cross section of the heat insulating board,

FIG. 3 is an enlarged fragmentary perspective view of the portion designated by arrow III in FIG. 1, and FIG. 4 is a perspective view of the exhaust manifold and heat insulating board.

FIGS. 5 through 8 show a prior art heat insulating board wherein:

FIG. 5 is a perspective view of the heat insulating board,

FIG. 6 is an enlarged cross section of the heat insulating board,

FIG. 7 is an enlarged fragmentary perspective view of the portion designated by arrow VII in FIG. 5, and FIG. 8 is a perspective view of the exhaust manifold and heat insulating board.

DETAILED DESCRIPTION

Figure 1:
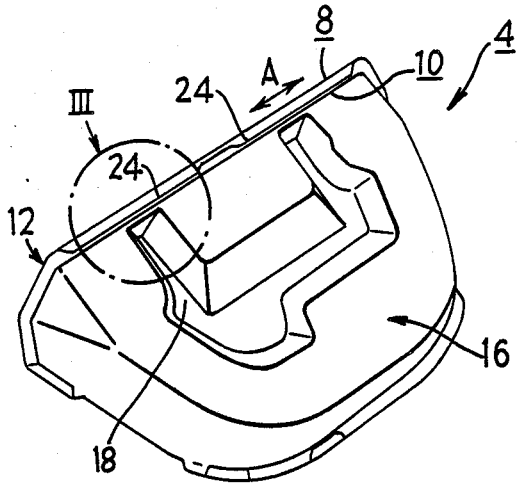

FIGS. 1 through 4 show a preferred embodiment of the present invention. In the drawings, members having the same functions are provided with the same reference numbers as used in FIGS. 5–8.

Figure 2:
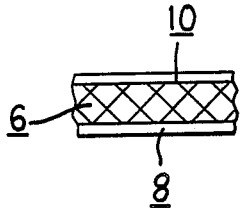
Figure 4:
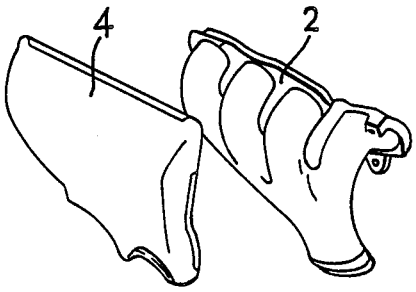
Figure 5:
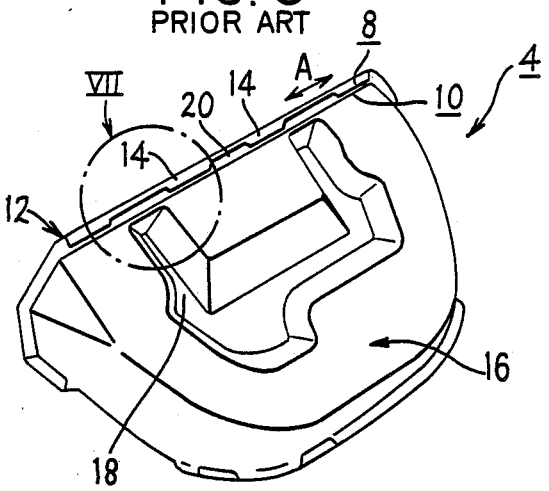
FIG. 5 PRIOR ART
Figure 6:
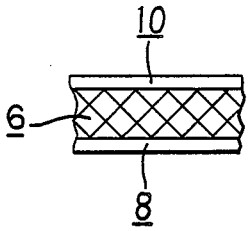
FIG. 6 PRIOR ART
Figure 7:
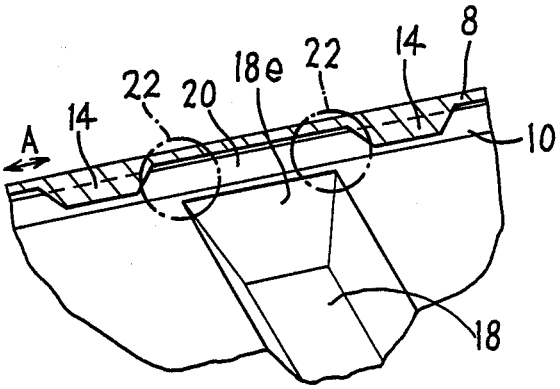
FIG. 7 PRIOR ART
Figure 8:
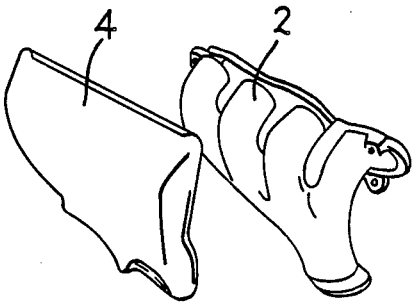
FIG. 8 PRIOR ART

That is, 2 represents the exhaust manifold and 4 the heat insulating board in FIG. 4. The heat insulating board 4 consists of an inside layer of material 8 and an outside layer of material 10 laminated together with a layer of heat insulator material 6 therebetween as shown in FIG. 2. The materials used as the inside material 8, outside material 10 and heat insulator 6 can be the materials customarily used in the prior art.

Figure 3:
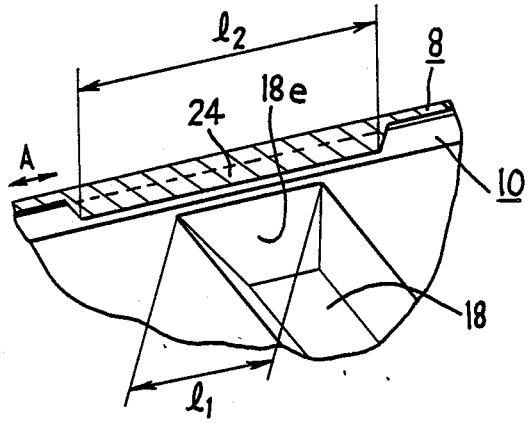

According to the invention, the heat insulating board 4 for the exhaust manifold 2 has a reinforcement connecting tab portion 24 (FIG. 3) with a length $l_2$ longer than the width $l_1$ of the end **18*e* of the depression 18, which depression is formed in the internal area 16 of the inside material 8 and the outside material 10 but excludes the peripheral area 12 as shown in FIGS. 1 and 3. This reinforced connecting tab portion 24 as formed in the peripheral edge 12 is disposed so as to be substantially aligned with this end 18*a* and, due to its length $l_2$, the portion 24 extends outwardly along the edge 12 a substantial distance beyond each side of the depression. The tab 12 is part of the inside material layer 8 and overlies the edge of outside material layer 10** and is fixed thereto, as by caulking. The width $l_1$ and the length $l_2$ should have values meeting the formula "$l_2 > l_1 + \text{alpha}$", where the value "alpha" is preferably at least about 20 mm.

Thus, it is possible to improve the strength of the peripheral area 12 facing the end 18*e* where thermal stress due to thermal deformation of the above depression 18 is concentrated by providing the reinforcing connecting tab portion 24 along the periphery 12 with the length $l_2$ longer than the width $l_1$ of end 18*e* of the depression 18. Therefore, it is possible to avoid increased costs because the heat insulating board 4 requires no reinforcement and prevents cracks.

As mentioned above, the device improves the strength of the peripheral area 12 facing the end 18*a* where thermal stress due to thermal deformation of the depressed section are concentrated by making the reinforcement connecting tab portion 24 longer than the width of the depression end 18*a* in the peripheral area facing the end 18*a* of the depression 18 formed in the internal area of the inside and outside materials.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An exhaust-manifold heat insulating board comprising a heat insulating material provided between an inside material layer and an outside material layer, said inside and outside layers being laminated together and defining an interior area and a peripheral edge area, said inner area having a depression formed therein, said depression forming an end wall portion disposed adjacent but spaced inwardly from said peripheral edge area, and said peripheral edge area having a connecting tab portion formed integrally on a peripheral edge of one said layer and overlapping and being fixedly secured to a peripheral edge of the other said layer, said connecting tab portion being positioned directly adjacent said end wall portion and having a length along the peripheral edge area greater than the width of the adjacent said end wall portion.

2. A board according to claim 1, wherein said depression is generally U-shaped and defines two said end wall portions disposed adjacent the peripheral edge area in spaced relation therealong, and said one layer having two said connecting tab portions thereon and spaced along said peripheral edge area so that each said connecting tab portion is positioned directly adjacent one of said end wall portions, each said tab portion extending along the peripheral edge area outwardly in opposite directions beyond the width of the respective end wall portion.

3. A board according to claim 1, wherein said tab portion extends along the peripheral edge area outwardly in opposite directions beyond the width of the end wall portion.

* * * * *